US009937542B2

(12) United States Patent
English

(10) Patent No.: US 9,937,542 B2
(45) Date of Patent: Apr. 10, 2018

(54) COMPACT MOBILE ROLL TILTER

(71) Applicant: Calvin Francis English, Rocklin, CA (US)

(72) Inventor: Calvin Francis English, Rocklin, CA (US)

( * ) Notice: Subject to any disclaimer, the term of this patent is extended or adjusted under 35 U.S.C. 154(b) by 205 days.

(21) Appl. No.: 14/936,563

(22) Filed: Nov. 9, 2015

(65) Prior Publication Data

US 2016/0130088 A1 May 12, 2016

Related U.S. Application Data

(60) Provisional application No. 62/077,863, filed on Nov. 10, 2014.

(51) Int. Cl.

| | |
|---|---|
| ***B21C 47/24*** | (2006.01) |
| ***B65H 19/30*** | (2006.01) |
| ***B65H 19/12*** | (2006.01) |

(52) U.S. Cl.

CPC ..... *B21C 47/242* (2013.01); *B65H 19/12* (2013.01); *B65H 19/30* (2013.01); *B65H 2301/3251* (2013.01); *B65H 2301/364* (2013.01); *B65H 2301/4172* (2013.01); *B65H 2405/422* (2013.01); *B65H 2405/441* (2013.01)

(58) Field of Classification Search

CPC ..... B21C 47/242; B65H 19/12; B65H 19/30; B65H 2301/3251; B65H 2301/364; B65H 2301/4172; B65H 2405/422; B65H 2405/441

USPC ..... 414/754–782; 29/281.1

See application file for complete search history.

(56) References Cited

U.S. PATENT DOCUMENTS

| | | | | |
|---|---|---|---|---|
| 2,567,819 A | | 9/1951 | Matteson et al. | |
| 3,016,158 A | | 1/1962 | Horton | |
| 3,106,864 A | * | 10/1963 | Seedlock | B60P 3/14 280/423.1 |
| 3,476,267 A | | 11/1969 | Clark | |
| 3,675,788 A | | 7/1972 | Cathers | |
| 3,763,990 A | | 10/1973 | Ouska | |
| 3,795,323 A | | 3/1974 | Ouska | |
| 3,831,782 A | | 8/1974 | Werntz | |
| 3,884,362 A | * | 5/1975 | Brenner | B65G 47/252 198/412 |
| 5,480,277 A | | 1/1996 | Minz | |
| 6,050,771 A | * | 4/2000 | Dykstra | B65G 59/08 414/773 |

* cited by examiner

*Primary Examiner* — Anna M Momper
*Assistant Examiner* — Lynn E Schwenning
(74) *Attorney, Agent, or Firm* — David J. Bremer

(57) ABSTRACT

The roll tilter supports a palleted roll of sheet or thin plate material and re-positions the roll for mounting to an unrolling fixture. The roll tilter received the roll resting on a pallet in a vertical centerline position and rotates the palleted roll from the vertical position to a position with the roll centerline in a horizontal position to facilitate mounting the roll on an unrolling fixture.

15 Claims, 5 Drawing Sheets

COMPACT MOBILE ROLL TILTER

Rolled or coiled material can range from paper to metal. The rolled material is generally quite thin in relation to the unrolled length and the rolls can typically weigh hundreds to thousands of pounds. These weights, combined with the fragile nature of the thin sheet material, can lead to significant damage to the outer layers and the edges of the roll, especially when the rolls are being repositioned during shipping or receiving.

BACKGROUND OF THE INVENTION

When processing sheet material, whether manufacturing the sheet itself or during secondary processing such as continuous roll forming, the roll is typically mounted through its center hole on a horizontal spindle or mandrel so that the material may be either rolled or unrolled depending on the application. However, when shipping, storing, and moving the rolls around a warehouse, the roll is most often positioned on its flat side with its center hole vertical. Some advantages of each configuration are fairly obvious: horizontal positioning permits rolling or unrolling the linear stock while the roll turns on a stationary horizontal axis with the weight of the roll supported on the inner spindle and the edges untouched (and undamaged)—vertical positioning places the roll in a stable position so that it can be placed on a pallet and moved using various conventional material handling equipment like forklifts and pallet jacks. The problem arises as to how to transition the roll between vertical and horizontal positions in a manner that protects both the roll and the workers moving the roll.

The job of mounting a palleted roll onto a spindle, for example, a feeder spindle for a roll forming process, is often left to warehouse workers or machine operators who must muscle the roll into position with fork lifts and makeshift slings. Moving these heavy rolls with manpower and improvised tools involves a good deal of manual handling during which the outer layers and edges of the roll can be damaged, deformed, and scratched. In addition, manhandling a 5000 lb roll of sheet steel to thread a sling through the center hole and between the pallet and the roll itself can result in various injuries, from cuts and scratches to broken limbs. Damaged material (i.e., scratched, dented, bent, etc.) must be cut from the roll and discarded prior to further processing, resulting in unnecessary scrap losses.

Conventional roll tilters (sometimes called up-enders) ate helpful in changing the position of rolls from their usual shipping position (with vertical central axis) to a horizontal position suitable for mounting the roll on an unrolling fixture, or, on the other hand, removing a roll mounted on a spindle and transferring it to a pallet for shipping or storage. Roll tilters can be massive, highly automated machines. Such tilters may be found in factories and specialized shops that work with rolled material on a regular basis. Some basic, stripped-down roll tilters have been produced for handling smaller rolls on a more occasional basis. However, in addition to the basic tilters being less robust and prime to malfunction, the rolls manipulated by currently available basic roll tilters are still vulnerable to damage while on the roll tilter.

Once in the horizontal position, the rolls must be freed from their shipping pallets. The weight of the roll makes this process challenging. Often freeing the pallet causes edge and surface damage to the roll and/or destroys the pallet. Mounting the roll on an unrolling fixture may require additional movement to clear the centerhole (e.g., remove the pallet) to accept a spindle from which the material can be continuously unrolled for forming. There exists a need for a compact yet full-featured roll tilter that can operate reliably and safely with minimal setup.

The unique roll tilter assembly described in this disclosure and accompanying figures includes several novel features that solve many problems encountered when handling rolled material.

DETAILED DESCRIPTION OF THE INVENTION

In this specification, like reference numbers appearing in multiple drawing figures indicate the same or similar elements.

The Compact Roll Tilter finds utility at least for positioning rolls of sheet and thin plate material. Such rolls are typically shipped and/or stored in a vertical position (i.e., with the centerline of the roll extending along a vertical axis) resting on a pallet. After shipping and prior to use, a roll is often mounted on an unspooling fixture having a horizontal spindle extending through the center hole of the roll. Once mounted on the unspooling fixture, the material of the roll can be unwound for further processing such as forming, cutting, bending, and trimming. Of course, the Compact Roll Tilter can be employed with equal success when demounting a roll from a horizontal position and transitioning the roll 90° to a vertical position for placement on a pallet.

Oftentimes, changing the roll position from vertical (as shipped) to horizontal (for unspooling) is done by forklift or a hoist connected to a lifting strap threaded through the roll center hole. Due to the weight and general ungainliness of the rolls, it can be difficult to separate the roll and pallet, i.e., the lifting strap may capture the pallet along with the roll. Alternatively, the roll may be tilted by hand, lifting up one edge of the roll, to allow the strap to be pulled through the center hole to the perimeter of the roll, excluding the pallet itself. This process may be difficult and dangerous with a risk of pinching extremities between the roll and the pallet or trapping a worker's hand or arm under the roll.

The Compact Roll Tilter provides mechanized means for moving the roll and pallet between the vertical and the horizontal positions while minimizing hazards related to moving such large and heavy objects. In addition, the Compact Roll Tilter has unique features that facilitate the moving and mounting processes.

Figure 1:
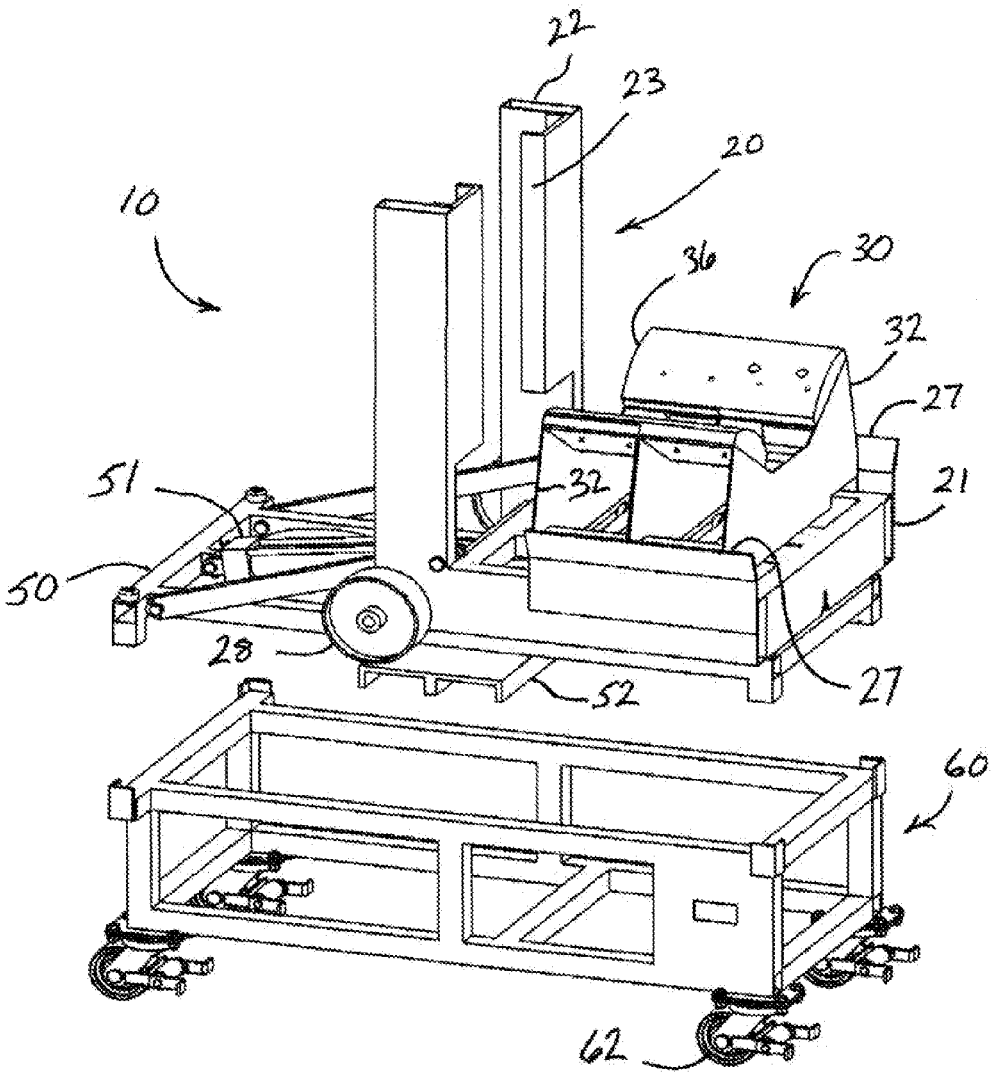
FIG. 1 illustrates an embodiment of the Compact Roll Tilter including the Pivot Assembly, the Tilter Base Bracket, and the Castor Frame.

FIG. 1 shows a roll tilter assembly 10 combined with an optional castor frame 60. The roll tilter assembly 10 includes a pivot assembly 20 mounted to a base bracket 50. The castor frame 60 employs castors, such as the castor 62, to enable the roll tilter 10 to be easily moved, and may also provide height adjustability for the roll tilter 10. In other configurations, the pivot assembly 20 and base bracket 50 may rest on a fixed support structure instead of the castor frame 60, for example, when the roll tilter assembly does not require the mobility provided by the castors 62 of the caster frame 60.

The pivot assembly 20 includes two platform components positioned at substantially right angles to each other and joined along a common side. "Substantially," as used here and throughout, is meant to accommodate conventional dimensional tolerances and the inconsistencies that are inherent in standard manufacturing processes. The slotted platform 22 supports the roll in the vertical position (see FIG. 2A). The slot 23 is centrally located and provides a clear path for a spindle to extend through the roll in the horizontal position (see FIG. 2B). The cradle platform 21 includes features such as the cradle fences 27 and cradle latches configured to guide and hold a cradle assembly 30 in place.

FIG. 1 also shows some sub-components of the pictured assemblies, such as the pivot assembly rollers 28, the linear actuator 51, and the base bracket roller platform 52. Details of the assemblies and sub-assemblies will follow in subsequent parts of this paper.

Figure 2A:
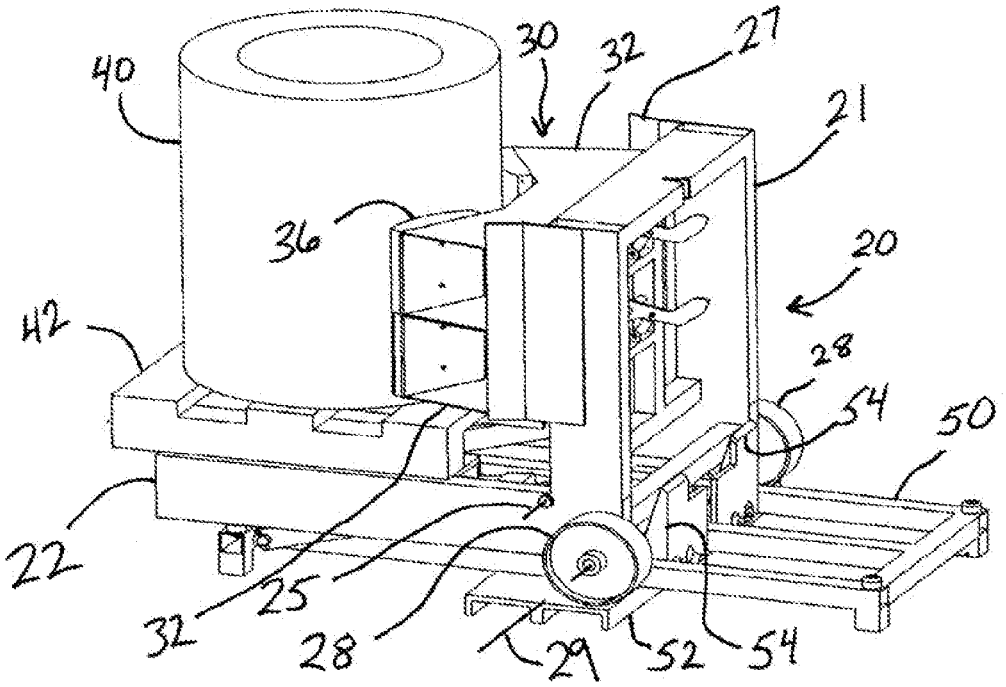
FIG. 2A illustrates an embodiment of the Compact Roll Tilter with the Pivot Assembly mounted on the Tilter Base Bracket and showing the Pivot Assembly in the vertical position.
Figure 2B:
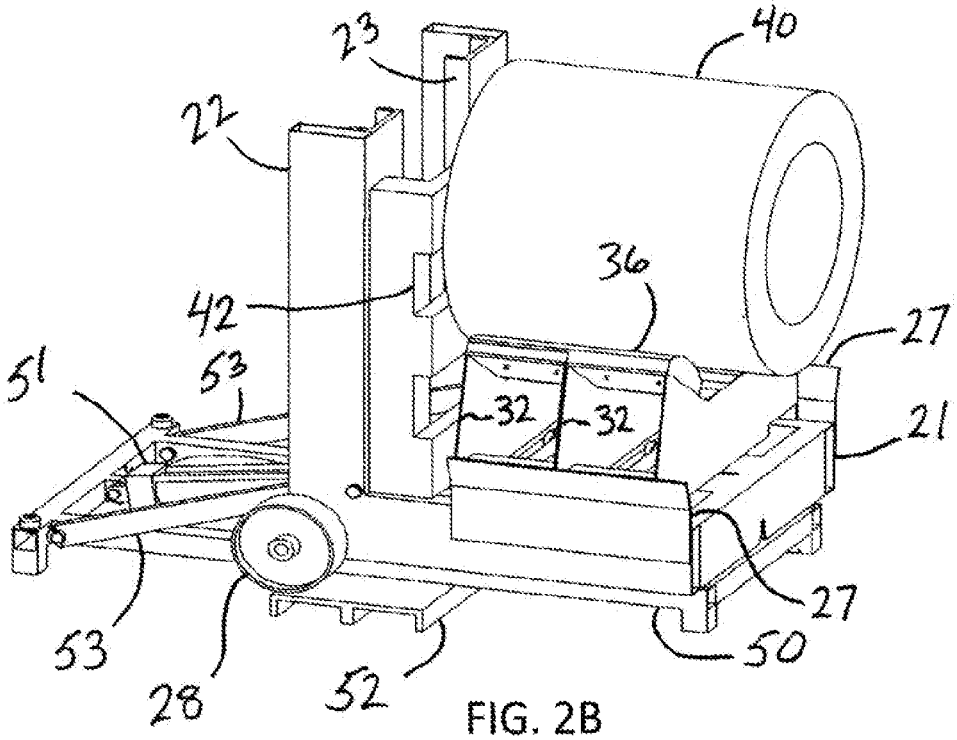
FIG. 2B illustrates an embodiment of the Compact Roll Tilter with the Pivot Assembly mounted on the Tilter Base Bracket and showing the Pivot Assembly in the horizontal position

FIGS. 2A-B show the roll tilter in its two fundamental positions: the vertical or loading position (2A), and the horizontal or unloading position (2B). In FIG 2A, the slotted platform 22 of the pivot assembly 20 supports a palleted roll 40 in the vertical position, as it would be positioned for shipping. This is the typical shipping configuration for rolled materials—minimizing the chance that the rolls may shift during transport. Also, with the roll laying flat on the pallet, the pallet can be easily unloaded from a truck or trailer and placed in the roll tilter 10 with a forklift.

Also shown in FIG. 2A is the cradle assembly 30 that comprises, in this embodiment, a set of two cradle sections 32 that will support the roll 40 in the horizontal position. As the roll tilter 10 rotates to the horizontal position seen in FIG. 2B, the roll 40 progressively settles onto the cushions 36 of the cradle assembly 30. Although it is not fully visible in FIG. 2A, the linear actuator 51 (a hydraulic cylinder in this embodiment) is fully extended when the pivot assembly 20 is in the vertical position, as indicated by the rollers 28 being positioned forward on the roller platform 52. Cradle wedges 54 are visible between the rollers 28. The function of the cradle wedges 54 will be discussed in detail later in this paper.

In the vertical position, the linear actuator (not shown in 2A) is fully extended, causing the rollers 28 to move forward along the roller platform 52. When the linear actuator is retracted, the rigid side links (also not shown in 2A), in concert with the retraction of the linear actuator 51, cause the pivot assembly 20 to rotate about the pivot axis 25 (also the link connection point) to the horizontal position shown in FIG. 2B.

In FIG 2B, the linear actuator 51 is shown fully retracted. Retraction pulls the rollers 28 back towards the linear actuator 51 on the roller platform 52 so that the pivot assembly 20 rotates about the pivot axis 25. As a result of the rotation, the pallet 42 and roll 40 transition to the horizontal position, where the roll 40 settles onto the cradle assembly 30. The configuration of the cradle assembly is self-centering, so that, even if the palleted roll is initially misaligned with respect to the cradle assembly, the roll will move into the center of the cradle assembly as it settles in the horizontal position. Thus, rotating the pivot assembly 20 automatically shifts the roll so that the center hole is aligned with the central slot 23 of the slotted platform 22. As the pivot assembly 20 reaches the end of its rotation, the cradle wedges 54 (not shown in this view) engage the nearside cradle 32 along its near edge, and the cradle assembly 30 is moved slightly along cradle platform 21 away from the pivot axis 25. This slight movement releases the pallet 42 from being clamped between the roll 40 and the slotted platform 22 and facilitates easy removal of the pallet 42.

Figure 3A:
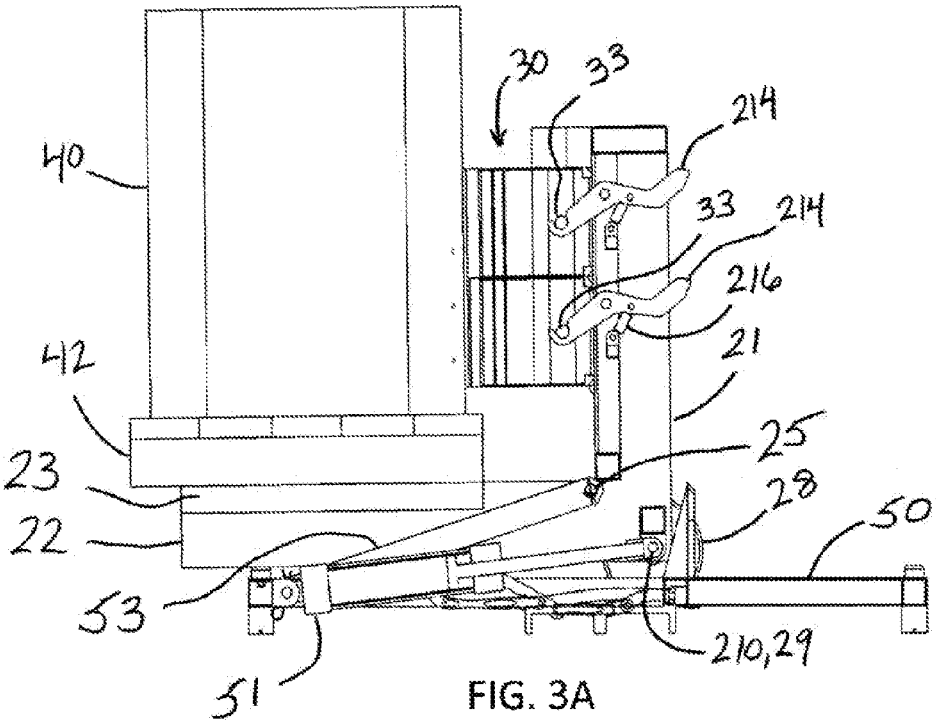
FIG. 3A is a side section view of an embodiment of the Compact Roll Tilter with the Pivot Assembly in the vertical position.

FIG. 3A is a section view of the pivot assembly 20 in the vertical (or loading) position with the palleted roll 40 resting on the slotted platform 22. In this view, the linear actuator 51 is seen in the extended position, and one of the two side links 53 is also visible. The distance between the actuator connection point 210 (in this embodiment, coincident with the roller axis) and the pivot axis 25 provides a moment arm necessary to rotate the pivot assembly 20 when the linear actuator 51 retracts.

FIG. 3A further illustrates the cradle latches 214 securing the cradle assembly 30 in place on the cradle platform 21. When the cradle platform 21 is lifted off the base bracket 50. the latch springs 216 pull the latches clockwise (in this view) to engage the latch pins 33 on the cradle sections 32. When latched, the cradle latches 214 hold the cradle sections 32 firmly in position on the cradle platform 21. Of course, other means and methods for rotating the latches 214, such as a resilient member or an air spring, may be employed here.

Figure 3B:
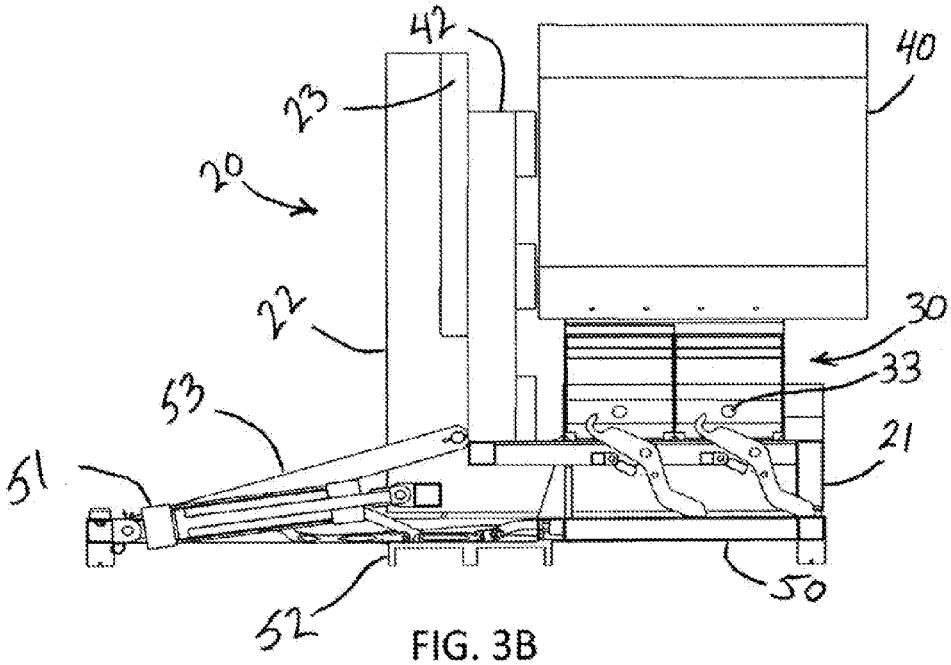
FIG. 3B is a side section view of an embodiment of the Compact Roll Tilter with the Pivot Assembly in the horizontal position.

In FIG. 3B, the pivot assembly 20 is shown in the horizontal position with the roll 40 (with its centerline horizontal) seated on the cradle assembly 30. The linear actuator 51 is fully retracted. Once again, the distance between the actuator connection point 210 and the pivot axis 25 provides a moment arm for reversing the rotation of the pivot assembly 20 when the linear actuator 51 extends.

As pivot assembly 20 rotates and the cradle platform 21 approaches horizontal, the lower ends of the cradle latches 214 contact the base bracket 50, and further rotation of the pivot assembly 20 causes the cradle latches 214 disengage from the latch pins 33. Also, as the cradle platform 21 approaches horizontal, the cradle wedges 54 engage the edge of the near side cradle section 32. Further rotation of the pivot assembly 20 results in the fixed cradle wedges 54 shifting the cradle assembly 30 a short distance along the cradle platform 21, releasing the pallet 42 from being clamped between the slotted platform 22 and the roll 40. Releasing the pallet 42 is important because the pallet 42 should be removed before inserting an unrolling spindle through the roll center hole. Once the pallet 42 is removed, the spindle slot 23 in the slotted platform 22 provides an open path to insert the spindle and lift the roll 40 with the spindle inserted.

Pivot Action

The pivot assembly utilizes a novel linkage and actuator combination that shortens the overall length of the base bracket 50 while providing a smooth transition between the vertical and horizontal positions.

The linear actuator provides the force to rotate the pivot assembly in either direction The linear actuator is anchored to the base bracket 50 and connects to the pivot assembly proximal the roller axis 29. Both linear actuator connections are effectively pinned connections that allow for rotation at the connection points. The rigid side links 53 are also pinned to the base bracket 50 and to the pivot assembly 20; however, the link connections to the pivot assembly are offset upwards from the linear actuator connection point. The offset distance between the link and linear actuator connections provides a moment arm that facilitates the rotation by the linear actuator and, because the link connection is always vertically offset from the linear actuator connection, the moment arm is present to some degree throughout the entire rotation of the pivot assembly, i.e., from the vertical to the horizontal position.

In addition to maintaining the moment arm, the side link/actuator link configuration enables the rollers 28 to reciprocate from one end of the roller platform to the other during rotation which, in turn, enables the pivot assembly to overlap a span of the base bracket approximately equal to the width of the roller platform—shortening the envelope of the pivot assembly as it moves between the vertical and horizontal positions.

Cradle Assembly

Figure 4:
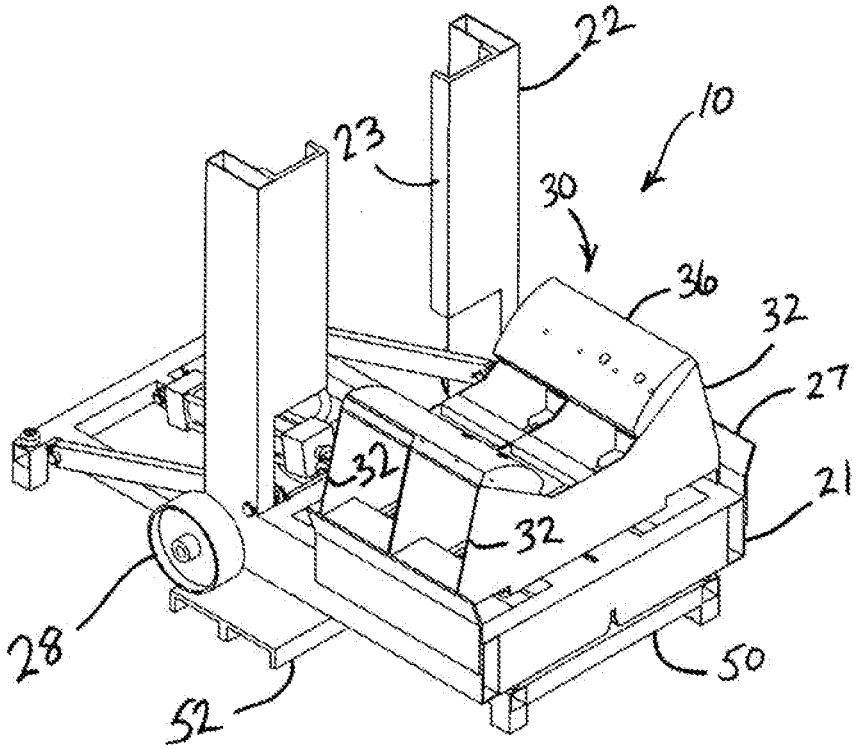
FIG. 4 illustrates an embodiment of the Pivot Assembly mounted on the Tilter Base Bracket with the Pivot Assembly in the horizontal position.

Rolls of sheet material require careful handling, since the small thickness of the sheet can make the material vulnerable to kinks, wrinkles, dents, and other surface damage. Additionally, some sheet materials are pre-painted or otherwise pre-finished before rolling, making the surface even more susceptible to surface damage. The roll tilter 10 incorporates a unique cradle assembly 30 that provides particular protection for the roll material FIG. 4 is a perspective view of an embodiment of the roll tilter 10. The cradle assembly 30 of the roll tilter 10 incorporates a modular design to accommodate rolls of different sizes and weights while protecting the outermost layers of the rolled material. The cradle assembly 30 adapts to different rolls in at least two ways: by providing multiple adjacent cradles 32 joined by a single continuous cushion, such as the double cushions 36, and by positioning the cushions so that they contact the rolls tangentially to the roll outer surface, even when rolls have widely different diameters. The multiple cradles 32 spread the load across the width of the roll and the cushion prevents dents or wrinkles caused by mismatched joints and excessive overhang.

The cradle assembly 30 rests on the cradle platform 21. The cradles are captured and retained on the cradle platform 21 in part by the cradle fences 27 on either side of the cradle platform 21. The cradle fences 27 permit sliding movement along the cradle platform 21 to facilitate easy assembly and also to enable the movement imposed by the cradle wedges 54 as the pivot assembly 20 moves into the horizontal position with a roll in place on the cradles.

Figure 5:
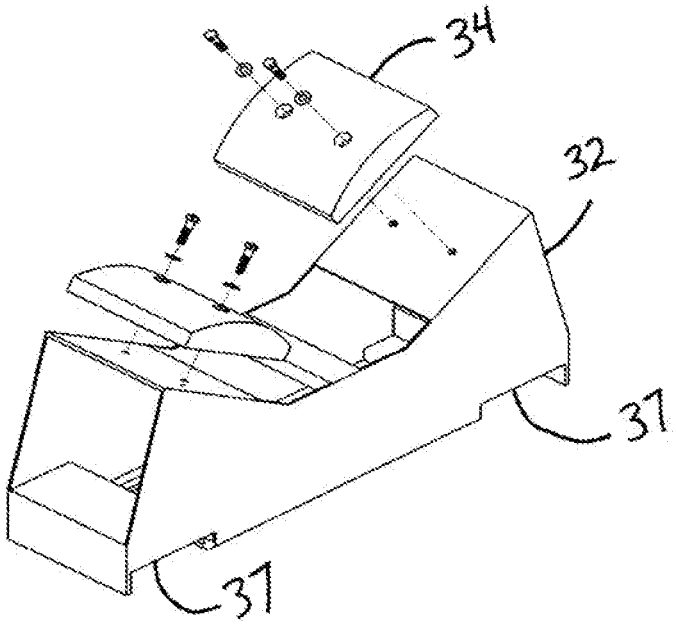
FIG. 5 is an exploded view of a single Cradle Assembly

The building blocks of the cradle assembly 30 are the individual cradle sections 32, illustrated in FIG. 5. Each cradle section includes two support surfaces set at opposite angles across a centerline. Each support surface includes a cushion, for example, the single cushion 34, fixed to the surface so that the cushion will be pressed between the roll and the support surface. Each cushion includes a flat mounting surface that abuts the support surface and a curved cushion face that contacts the outer surface of the roll. Combining the angled configuration of the support surfaces with the curved face of the cushions ensures that the roll sits on two curved faces that contact the roll tangentially—reducing the possibility of denting or creasing the roll material with a corner or sharp edge. The cradle, in some embodiments, may also include slots 37 to enable the cradle or cradle assembly to be lifted on or off the cradle platform using a fork-lift.

Additionally, the height of the cradle cushions 34, 36 from the cradle platform 21 can provide necessary clearance when mounting the roll on a spool. This height may be especially useful when the roll is to be mounted on a spool having flanges with diameters greater than the diameter of the roll. Such spools may be disassembled by removing at least one flange and insetting the spool barrel through the center hole of the roll. Then, the flange is reattached to the spool barrel opposite the remaining flange and the spool flanges effectively capture the roll on the spool.

The cushion may comprise resilient material such as nylon. Teflon and other synthetic materials, and may comprise wood or another relatively rigid material. In some applications, a cushion may be metal that is ground and/or polished to a highly smooth surface. The cushion may comprise combinations of material, or may be covered by a non-scratch or soft material. Various other materials and combinations thereof may be used for the cushion.

For wider or heavier rolls, the cradle assembly 30 can comprise one, two, or more individual cradle sections stacked along the cradle platform 21. The multiple configurations of cradle assemblies are useful for tailoring the roll tilter 10 for operation with different sized rolls. Depending on various factors such as roll material, material thickness, overall weight, and surface preparation, cradle sections 32 may be added to the assembly as needed to evenly support rolls of different widths and varying weights. In multiple cradle section assemblies, the support surfaces of adjacent cradle sections are attached to a single cushion that spans the multiple cradle sections and distributes the load across the cradle assembly. By spreading the roll load across multiple cradle sections, the cradle assembly 30 minimizes dents and kinks to the outer surface of the roll that may arise when a heavy roll overhangs a narrow cradle sections. The cushions that span multiple cradle sections, for example, the double cushions 36 shown in FIG. 1, can further minimize damage to the roll by eliminating small height differences or gaps between the adjacent cradle sections. Cushions for multiple cradle assemblies may be provided as standard sized sets with the roll tilter and may also be made to order for special applications.

Pallet Release Feature

In the vertical position, the weight of the toll may impose significant force on the pallet, effectively clamping the pallet between the slotted platform and the roll. When the pivot assembly 10 transitions to the horizontal position, the pallet may still be clamped between the roll 40 and the slotted platform, even though the weight of the roll is supported by the cradle assembly 30. Since the pallet can prevent a spindle from extending through the center hole of the roll, the pallet must be removed to allow the spindle to extend through the roll and into the spindle slot 23.

The roll tilter employs a novel wedge feature fixed to the base bracket 50 that engages the cradle assembly 30 as the pivot assembly approaches the horizontal position, and shifts the cradle assembly 30 away from the slotted platform 22 to release the pallet 40.

Figure 6A:
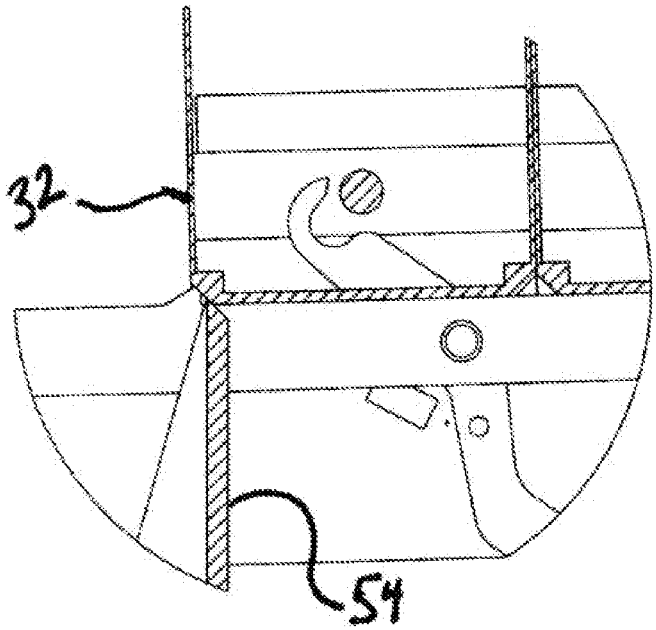
FIG. 6A is a detail view showing the cradle wedge contacting the cradle section.
Figure 6B:
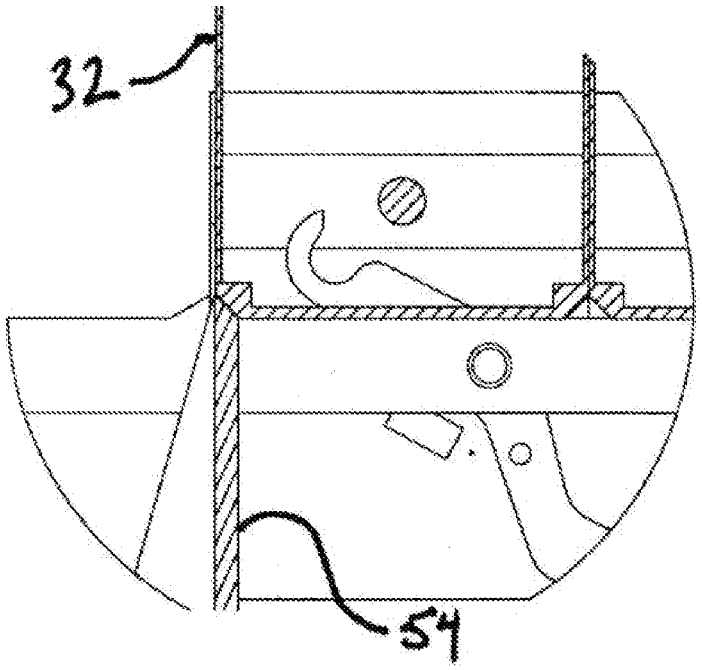
FIG. 6B is a detail view showing the cradle wedge and cradle section after the cradle section is shifted.

The cradle wedges 54, shown in FIGS. 3A-B, and 6A-B, are fixed to and extend upwards from the base bracket 50 proximal the roller platform 52. The detail views of FIGS. 6A-B illustrate how the cradle wedges 54 shift the cradle sections 32 as the pivot assembly 20 approaches the horizontal position.

The cradle wedges 54 are configured to engage the edge of the nearside cradle section 32 when the pivot assembly 20 approaches the horizontal position. The edge of the cradle section 32 includes a bevel that matches the bevel at the tips of the cradle wedges 54. FIG. 6A shows the position of the cradle section 32 with respect to the cradle wedge 54 as the pivot assembly 20 approaches horizontal. In this embodiment, somewhere between 85° and 90°, the bevels on the cradle wedge 54 and the cradle section 32 come into contact. It is evident in FIG. 6A that the cradle section 32 overhangs the cradle wedges 54 slightly as they come together.

In FIG. 6B, the cradle assembly bevel has moved down the wedge bevel as the pivot assembly 20 reaches 90° (horizontal ), resulting in a small translation of the cradle assembly 30 away from the pallet. The imposed translation creates a gap between the roll 40 and the pallet 42—freeing the pallet sufficiently that it may be removed from between the roll 40 and the slotted platform 22.

The invention claimed is:

1. A roll tilter system comprising:

a base bracket including one or more cradle wedges fixed thereon and extending upwards from the base bracket;

a pivot assembly connected to the base bracket, the pivot assembly including a slotted platform and a cradle platform, the slotted and cradle platforms joined together and extending perpendicularly outwards from each other, the pivot assembly having a loading position in which the cradle platform is substantially vertical and the slotted platform is substantially horizontal and an unloading position in which the cradle platform is substantially horizontal and the slotted platform is substantially vertical;

a cradle assembly mounted to the cradle platform for translation along the cradle platform toward and away from the slotted platform;

a pivot actuator connected between the base bracket and the pivot assembly and, in use, rotating the pivot assembly about a pivot axis between the vertical position and the horizontal position:

wherein (i) the pivot actuator rotates the pivot assembly about the pivot axis from the loading position to the unloading position, (ii) the cradle assembly, as the pivot assembly approaches the unloading position, contacts the one or more cradle wedges, and (iii) the cradle assembly, after contacting the one or more cradle wedges, translates along the cradle platform away from the slotted platform as the pivot assembly reaches the unloading position.

2. The roll tilter system of claim 1, wherein the pivot actuator retracts to rotate the pivot assembly from the loading position to the unloading position and extends to rotate the pivot assembly from the unloading position to the loading position.

3. The roll tilter system of claim 2, wherein the pivot actuator is connected to the pivot assembly proximal to the pivot axis, and wherein a distance between the pivot axis and the roll axis provides a moment arm to facilitate rotation of the pivot assembly by the pivot actuator.

4. The roll tilter system of claim 1, further comprising:

a roller supporting the pivot assembly on the base bracket, the roller connected to the pivot assembly at a roller axis and rolling along the base bracket while the pivot assembly rotates about the pivot axis, the roller axis being parallel to and spaced apart from the pivot axis; and a link arm connecting the pivot assembly to the base bracket, the link arm being rotatably connected to both the pivot assembly and the base bracket at the pivot axis so that the pivot assembly moves with respect to the base bracket at a fixed radius that corresponds to the link arm while the pivot assembly rotates about the pivot axis.

5. The roll tilter system of claim 1, wherein the cradle assembly comprises first and second support surfaces positioned at opposite angles across a centerline of the cradle assembly, and wherein a roll positioned on the slotted platform becomes centered across the centerline via contact with the first and second support surfaces as the pivot assembly rotates from the loading position to the unloading position.

6. The roll tilter system of claim 5, wherein the cradle assembly further comprises a plurality of abutted cradles extending along the centerline, wherein the first and second support surfaces of the plurality of cradles are spanned by a single respective first and second cushions to provide seamless support across the plurality of cradles.

7. The roll tilter system of claim 6, wherein the first and second cushions comprise resilient material.

8. The roll tilter system of claim 1, wherein the cradle platform includes opposite cradle fences configured to capture the cradle assembly while enabling the cradle assembly to move along the cradle platform.

9. The roll tilter system of claim 1, wherein the cradle platform includes a plurality of cradle latches biased to extend between the cradle platform and the base bracket, the cradle latches engaging pins on the cradle assembly when the pivot assembly is not in the unloading position, and wherein, as the pivot assembly approaches the unloading position, the cradle latches contact the base bracket and rotate to disengage the pins on the cradle assembly.

10. A method of moving a roll of material from a roll-axis-vertical position to a roll-axis-horizontal position with a roll tilter system, the roll tilter system including a pivot assembly rotatably mounted to a base bracket, the pivot assembly including a slotted platform joined together with a cradle platform perpendicular to the slotted platform, the method comprising:

loading a roll in the roll-axis-vertical position onto the slotted platform with the stoned platform substantially horizontal and the cradle platform substantially vertical;

rotating, via a pivot actuator connected between the base bracket and the pivot assembly, the pivot assembly to move towards the roll-axis-horizontal position;

continuing to rotate the pivot assembly to transfer, via gravitational force, the roll from the slotted platform to a cradle assembly mounted to the cradle platform;

continuing to rotate the pivot assembly to cause the roll to move, via gravitational force, between spaced apart first and second support surfaces positioned at opposite angles across a centerline of the cradle assembly;

engaging, via contact with the base bracket as the cradle platform approaches horizontal, cradle latches connected to the cradle platform with pins on the cradle assembly, the cradle latches extending between the cradle platform and the base bracket; and translating, via contact between cradle wedges fixed to the base bracket and the cradle assembly, the cradle assembly along the cradle platform away from the slotted platform.

11. The method of claim 10, further comprising centering the roll on the cradle assembly with the pivot assembly in the roll-axis-horizontal position, such that a spindle is insertable through a central slot of the slotted platform into a roll center hole aligned with the central slot.

12. The method of claim 11, further comprising lifting the roll off the cradle assembly via the roll center hole.

13. A roll tilter system comprising:

a base bracket including one or more cradle wedges fixed thereon and extending upwards from the base bracket;

a pivot assembly connected to the base bracket by a link arm and supported by a roller interposed between the pivot assembly and the base bracket, the link arm being rotatably connected to the pivot assembly and to the base bracket so that the pivot assembly moves with respect to the base bracket at a fixed radius that corresponds to the link arm while the pivot assembly rotates about the pivot axis, the pivot assembly including a slotted platform and a cradle platform, the slotted and cradle platforms joined together and extending perpendicularly outwards from each other, the pivot assembly having a loading position in which the cradle platform is substantially vertical and the slotted platform is substantially horizontal and an unloading position in which the cradle platform is substantially horizontal and the slotted platform is substantially vertical;

a cradle assembly mounted to the cradle platform for translation toward and away from the slotted platform;

a pivot actuator connected between the base bracket and the pivot assembly and, in use, rotating the pivot assembly about a pivot axis between the loading position and the unloading position;

wherein (i) the pivot actuator rotates the pivot assembly about the pivot axis from the loading position to the unloading position, (ii) the cradle assembly, as the pivot assembly approaches the unloading position, contacts the one or more cradle wedges, and (iii) the cradle assembly, after contacting the one or more cradle wedges, translates along the cradle platform away from the slotted platform as the pivot assembly reaches the unloading position.

14. The roll tilter system of claim 13, wherein the roller rotates about a roller axis proximal to a meeting point of the cradle and slotted platforms, and wherein the roller axis is spaced apart from and below the pivot axis.

15. The roll tilter system of claim 13, wherein the slotted platform comprises two opposite arms extending perpendicularly away from the cradle platform and a central slot between the two opposite arms, the two opposite arms supporting the roll in the loading position and the central slot accommodating a spindle inserted into a center hole of the roll in the unloading position.

* * * * *